US006222350B1

(12) United States Patent
Mosley

(10) Patent No.: US 6,222,350 B1
(45) Date of Patent: Apr. 24, 2001

(54) HIGH TEMPERATURE VOLTAGE REGULATOR CIRCUIT

(75) Inventor: Demmie L. Mosley, Amarillo, TX (US)

(73) Assignee: Titan Specialties, Ltd., Pampa, TX (US)

( * ) Notice: Subject to any disclaimer, the term of this patent is extended or adjusted under 35 U.S.C. 154(b) by 0 days.

(21) Appl. No.: 09/489,103

(22) Filed: Jan. 21, 2000

(51) Int. Cl.[7] ..... G05F 1/613
(52) U.S. Cl. ..... 323/231
(58) Field of Search ..... 323/220, 223, 323/225, 226, 229, 231

(56) References Cited

U.S. PATENT DOCUMENTS

| | | | | |
|---|---|---|---|---|
| 5,204,612 | * | 4/1993 | Lingstaedt | 323/317 |
| 5,519,313 | * | 5/1996 | Wong et al. | 323/315 |
| 5,585,949 | * | 12/1996 | Yamazaki et al. | 349/41 |
| 5,621,307 | * | 4/1997 | Beggs | 323/313 |
| 5,949,122 | | 9/1999 | Scaccianoce | 257/469 |

* cited by examiner

*Primary Examiner*—Matthew Nguyen
(74) *Attorney, Agent, or Firm*—Klein & Szekeres, LLP

(57) ABSTRACT

A high voltage shunt regulator circuit includes a high voltage device with a predetermined reverse-conduction threshold connected in series with a thermal compensation device comprising a plurality of gate threshold amplifiers connected in series with one another. The high voltage device includes a plurality of zener diodes connected in series. Each of the gate threshold amplifiers includes a resistive voltage divider and a voltage-controlled resistive device, preferably a MOSFET. The voltage divider is formed by first and second resistors connected in series between first and second terminals of the gate threshold amplifier, with a MOSFET having its drain connected to the first terminal, its source connected to the second terminal, and its gate connected to an intermediate tap of the voltage divider. The zener diodes provide high voltage regulation (up to at least about 1600V), while the thermal compensation device exhibits a negative temperature coefficient that substantially offsets the positive temperature coefficient of the zener diodes. This allows efficient operation at temperatures at least as high as about 200° C. The gate threshold amplifiers, each including a voltage-controlled resistive device, allow operation at low shunt regulation currents, i.e., on the order of about 25 μamps to about 500 μamps.

23 Claims, 3 Drawing Sheets

HIGH TEMPERATURE VOLTAGE REGULATOR CIRCUIT

CROSS-REFERENCE TO RELATED APPLICATIONS

Not Applicable

FEDERALLY SPONSORED RESEARCH OR DEVELOPMENT

Not Applicable

BACKGROUND OF THE INVENTION

This invention relates to generally to the field of discrete component shunt voltage regulator circuits. More specifically, it relates to a shunt voltage regulator circuit suitable for high voltage, low current applications, especially in high temperature environments.

Shunt voltage regulators are components or circuits that are usually connected in parallel with a particular electronic device, or across the input or output terminals of a circuit, to limit the voltage that can be applied across the device or between the terminals. The shunt regulator performs this function by conducting very little current until a preset voltage is reached, at which point the regulator becomes a very low resistance device that conducts a high current.

A well-known type of shunt voltage regulator is the zener diode. A zener diode exhibits a very high resistance, and thus allows the passage of very small currents, until a predefined reverse threshold voltage (or "zener" voltage) is applied across it. When the zener voltage is reached or exceeded, the zener diode becomes conductive with a variable current at the zener voltage. Zener diodes are commonly available with zener voltages of about 2 volts to about 400 volts. A problem with zener diodes is that those with zener voltages above about 5 or 6 volts exhibit large positive temperature coefficients (expressed in V/° C.), as shown in the graph of FIG. 1. Thus, high voltage zener diodes are not suitable in many applications in which high ambient temperatures may be experienced. Of course, a large number of low voltage zener diodes may be connected in series to provide a high voltage regulator that is relative temperature-stable, but this is usually impractical in terms of cost and space considerations.

U.S. Pat. No. 5,949,122—Scaccianoce discloses an integrated circuit that provides thermal compensation for a series string of zener diodes, in which several bipolar transistors are connected as $V_{BE}$ multipliers. While this circuit provides temperature-stable high voltage regulation, it may not work well at very low collector currents. This is because the bipolar transistors are connected in a common emitter configuration, in which the collector current ($I_C$) in each transistor is equal to the base current ($I_B$) multiplied by the common emitter gain ($H_{FE}$) of the transistor. The value of $H_{FE}$ for a typical bipolar transistor is in the range of about 10 to about 200. Since the collector current in the Scaccianoce device is the shunt regulation current, the base current would be between 0.5% and 10% of the shunt regulation current. Thus, at low shunt regulation currents (i.e., about 25 $\mu$amps to about 500 $\mu$amps), the base current would be at or near the value of the collector cutoff current (the collector-to-base leakage current, or $I_{CBO}$) for typical bipolar transistors. There are bipolar transistors with values of $I_{CBO}$ low enough to allow the Scaccianoce device to work at low shunt regulation currents, but the value of $I_{CBO}$ exhibits a large positive temperature coefficient, especially at temperatures above about 100° C. Thus, as a practical matter, a device constructed in accordance with the Scaccianoce disclosure to operate at low shunt regulation currents would be limited to operation in temperatures below about 125° C.

The prior art also includes a gas discharge tube device that operates in the corona mode of discharge. This device operates as a high voltage equivalent of a zener diode, and it functions well with low shunt regulation currents and at high temperatures (100° C. to 200° C.). These devices are fragile, however, and expensive, and they require a radioactive component (a beta emitter), which may present a health concern in some contexts.

There is thus a need for a high voltage regulation device that can operate with low shunt regulation currents in high temperature environments. There is a further need for a device that meets these operational criteria, and that may also be realized in a space-efficient and shock-resistant package.

SUMMARY OF THE INVENTION

Broadly, the present invention is a high voltage shunt regulator circuit comprising a high voltage device with a predetermined reverse-conduction threshold connected in series with a thermal compensation device comprising a plurality of gate threshold amplifiers connected in series with one another. The high voltage device comprises a plurality of zener diodes connected in series. Each of the gate threshold amplifiers comprises a resistive voltage divider and a voltage-controlled resistive device, preferably a MOSFET. Specifically, the voltage divider comprises first and second resistors connected in series between first and second terminals of the gate threshold amplifier, with a MOSFET having its drain connected to the first terminal, its source connected to the second terminal, and its gate connected to an intermediate tap of the voltage divider.

The zener diodes provide high voltage regulation (up to at least about 1600V), while the thermal compensation device exhibits a negative temperature coefficient that substantially offsets the positive temperature coefficient of the zener diodes. This allows efficient operation at temperatures at least as high as about 200° C. The gate threshold amplifiers, each including a voltage-controlled resistive device, allow operation at low shunt regulation currents, i.e., on the order of about 25 $\mu$amps to about 500 $\mu$amps.

The present invention is preferably realized with discrete components, thereby minimizing costs. Because only a few components are needed, even for the regulation of high voltages in relatively high temperature environments, efficient use of space is achieved. Furthermore, the use of solid state components provides a high degree of resistance to mechanical shocks and vibrations. These and other advantages of the present invention will be better appreciated from the detailed description that follows.

DETAILED DESCRIPTION OF THE INVENTION

Figure 2:
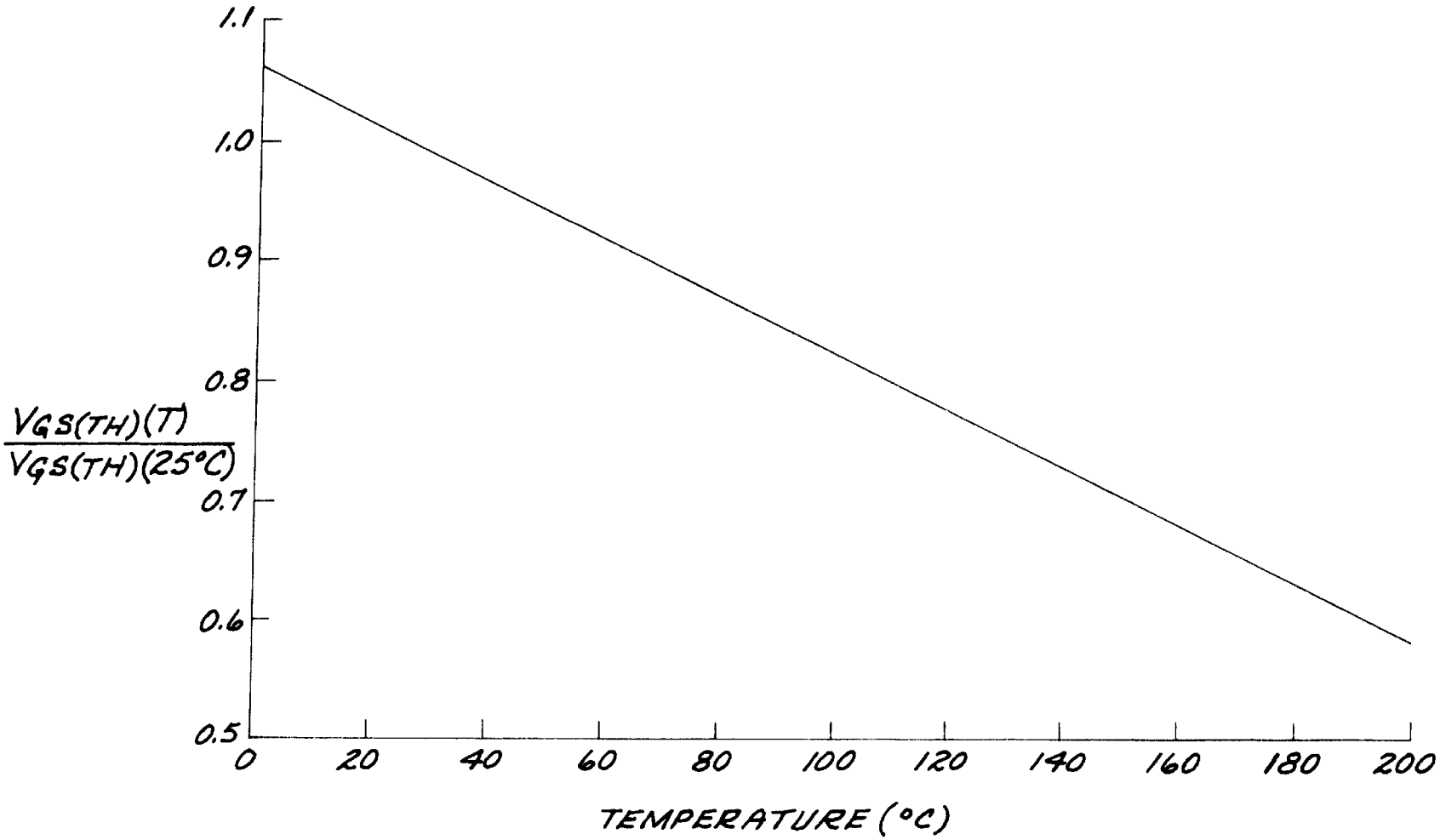
FIG. 2 is a representative graph of gate threshold voltage versus temperature for a typical MOSFET.

The present invention, in its preferred embodiment, exploits an advantageous characteristic of MOSFET devices that is illustrated in FIG. 2. The MOSFET device has a gate threshold voltage ($V_{GS(TH)}$), defined as the lowest voltage from the source to the gate at which a specified (low) value of drain current begins to flow. As shown in FIG. 2, the value of $V_{GS(TH)}$ (normalized in the graph to a value of 1 at 25° C.) decreases substantially linearly as a function of temperature between 0° C. and 200° C. Thus, it can be seen that as temperature increases, the value of $V_{G(TH)}$ for a MOSFET decreases, while the value of the zener voltage for a zener diode increases. By appropriately combining a MOSFET gate threshold amplifier, having suitably selected component values, with a zener diode chain selected for a specified total zener voltage, the offsetting temperature coefficients of the MOSFETs and the zener diodes can be used to maintain the total zener voltage sufficiently close to the specified total zener voltage for practical utility at elevated temperatures.

Figure 3:
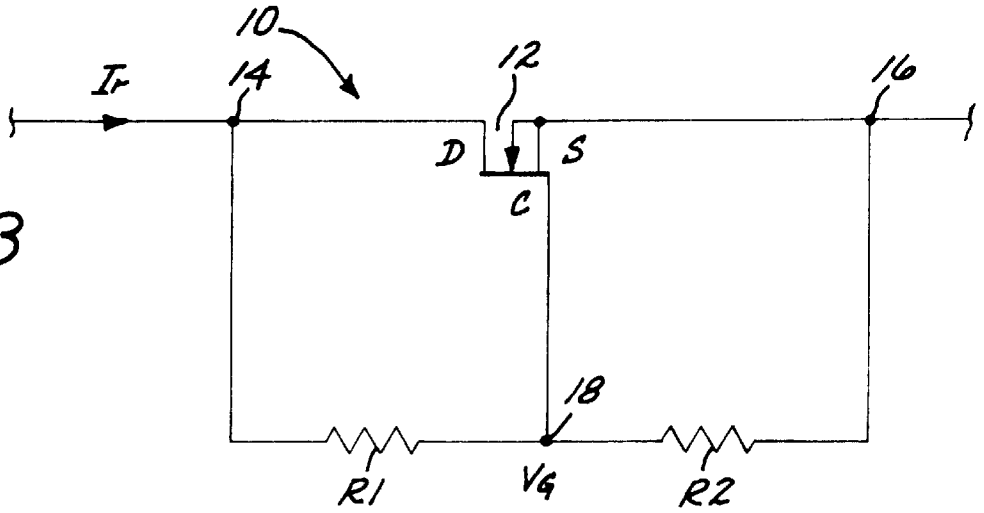
FIG. 3 is a circuit diagram of a MOSFET gate threshold amplifier, of the type used in a preferred embodiment of the present invention.

A MOSFET gate threshold amplifier 10, suitable for use in the present invention to achieve the above-mentioned goal, is shown in FIG. 3. The gate threshold amplifier 10 comprises a MOSFET 12 having a drain D, a source S, and a gate G. The drain D is connected to a first terminal 14, and the source S is connected to a second terminal 16. The MOSFET 12 shown in FIG. 3 is an n-channel MOSFET. It will be understood that a p-channel MOSFET can be used instead, with circuit modifications that will readily suggest themselves to those skilled in the pertinent arts.

A voltage divider is connected between the first and second terminals. The voltage divider comprises a first resistor $R_1$ connected between the drain D and the gate G of the MOSFET 12, and a second resistor $R_2$ connected between the gate G and the source S of the MOSFET 12. Thus, the gate G of the MOSFET 12 is connected to an intermediate tap 18 between the resistors $R_1$ and $R_2$.

The MOSFET 12 will not conduct until the gate-source voltage ($V_{GS}$) is at least equal to the gate threshold voltage ($V_{GS(TH)}$). If the drain-source voltage ($V_{DS}$) is sufficient to result in a gate-source voltage that is greater than $V_{GS(TH)}$, then the MOSFET will conduct until the gate-source voltage (created by the voltage divider $R_1+R_2$) decreases to the value of $V_{GS(TH)}$. A state of equilibrium is then reached at the condition of $V_{GS}=V_{GS(TH)}$.

The gate-source voltage may be expressed as:

$$V_{GS}=V_{DS}R_2/(R_1+R_2), \tag{1}$$

so that when $V_{GS}=V_{GS(TM)}$, $$V_{GS(TH)}=V_{DS}R_2/(R_1+R_2). \tag{2}$$

Solving for $V_{DS}$ yields:

$$V_{DS}=V_{GS(TH)}\times(R_1+R_2)/R_2. \tag{3}$$

As can be seen from FIG. 2, discussed above, $V_{GS(TH)}$ decreases substantially linearly with temperature. The change in $V_{DS}$ as a function of temperature could thus be expressed as:

$$\Delta V_{DS}(T)=\Delta V_{GS(TH)}(T)\times(R_1+R_2)/R_2. \tag{4}$$

Equation (4) means that the temperature-dependent change in drain-source voltage ($\Delta V_{DS}$) is equal to the temperature-dependent change in the gate threshold voltage ($\Delta V_{GS(TH)}$), amplified by the resistance ratio $(R_1+R_2)/R_2$.

Figure 4:
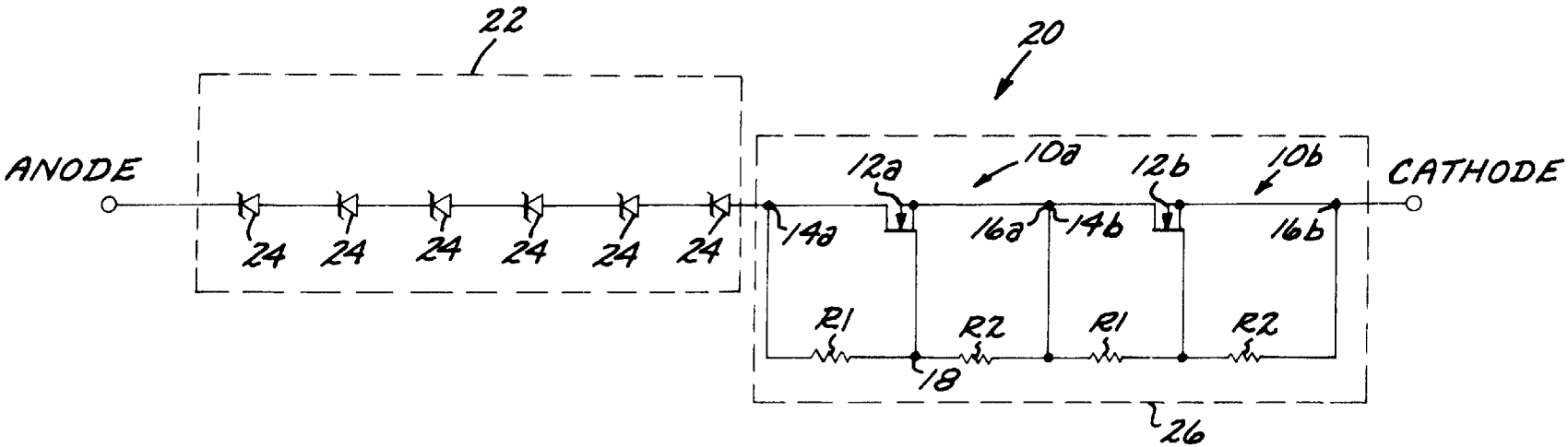
FIG. 4 is a circuit diagram of a 1600 volt regulator constructed in accordance with a preferred embodiment of the present invention.

FIG. 4 shows a specific example of a voltage shunt regulator circuit 20, constructed in accordance with a preferred embodiment of the present invention, using MOSFET gate threshold amplifiers, of the type described above and illustrated in FIG. 3. The regulator circuit 20 is designed to provide a regulated voltage of 1600V at temperatures up to about 200° C., and with shunt regulation currents as low as about 25 $\mu$amps.

The circuit 20 includes a high voltage device 22 comprising a string of six zener diodes 24, each having a zener voltage of 200V at 25° C. Thus, at 25° C., the high voltage device 22 has a total zener voltage of 1200V. The high voltage device 22 is connected in series with a thermal compensation device 26. Thus, to achieve a total regulated voltage of 1600V, the thermal compensation device 26 must produce a voltage drop of 400V.

The thermal compensation device 26 preferably comprises at least one of the above-described MOSFET gate threshold amplifiers 10. Because high voltage MOSFETS tend to be quite large in physical size, high voltage applications in which a small size for the voltage regulator circuit is desired will typically require a string of at least two gate threshold amplifiers 10 connected in series with each other, each having a medium voltage MOSFET 12. In the illustrated embodiment, two gate threshold amplifiers 10*a* and 10*b* are employed, including MOSFETs 12*a* and 12*b*, respectively. To achieve a voltage drop of 400V across the thermal compensation device 26, there must be a drain-source voltage drop $V_{DS}$ of 200V across each of the two gate threshold amplifiers 10*a* and 10*b*.

Each of the gate threshold amplifiers 10*a*, 10*b* includes a first terminal 14*a*, 14*b*, respectively, and a second terminal 16*a*, 16*b*, respectively. Connected between the first and second terminals of each of the gate threshold amplifiers 10*a*, 10*b*, is a resistive voltage divider comprising a first resistor $R_1$ and a second resistor $R_2$, with an intermediate tap 18 therebetween, as described above in connection with FIG. 3. The first terminal 14*a* of the first gate threshold amplifier 10*a* is connected to the high voltage device 22 and to the drain of the first MOSFET 12*a*. The second terminal 16*a* of the first gate threshold amplifier is connected to the source of the first MOSFET 12*a* and to the drain of the second MOSFET 12*b* through the first terminal 14*b* of the second gate threshold amplifier 10*b*. The second terminal 16*a* of the first gate threshold amplifier 10*a* and the first terminal 14*b* of the second gate threshold amplifier 10*b* are also commonly connected to the second resistor $R_2$ of the first gate threshold amplifier 10*a* and the first resistor $R_1$ of the second gate threshold amplifier 10*b*. Each of the gates of the MOSFETs 12*a*, and 12*b* is connected to the intermediate tap 18 of the voltage divider of the gate threshold amplifier in which that MOSFET is included.

For each of the gate threshold amplifiers 10*a* and 10*b*, a type of MOSFET having a drain-source breakdown voltage well in excess of of 200V was selected. Within this type, the range of gate threshold voltages at 25° C. was about 2.0V to 4.0V. Specimens were selected that exhibited a test value of $V_{GS(TH)}$ of 2.75V at 25° C. One can find the ratio of the resistances $R_1$ and $R_2$ using Equation (3) above, with the value of the gate threshold voltage at 25° C. (2.75V) and the desired drain-source voltage drop of 200V across each of the gate threshold amplifiers 10:

$$200=2.75(R_1+R_2)/R_2 \tag{5}$$

$$R_1=71.73R_2 \tag{6}$$

For proper operation of the gate threshold amplifiers 10*a* and 10*b*, the drain-source current ($I_{DS}$) must be substantially greater than the current through the voltage divider. For example, one might design the gate threshold amplifier circuit so that $I_{DS}$ is at least about ten times the value of the current through the voltage divider. Thus, if shunt regulation currents as low as about 25 $\mu$amps are desired, the resistances $R_1$ and $R_2$ may be selected so that the current through the divider is not more than about 2 $\mu$amps. Therefore, given the ratio set forth in Equation (6) above, if $R_1$ is selected to be 100 Megohms, then $R_2$ would be 1.39 Megohms.

At 200° C., as seen from FIG. 2, the value of $V_{GS(TH)}$ is about 0.58 times the value of $V_{GS(TH)}$ at 25° C. For the MOSFETs 12*a* and 12*b* selected as described above, the value of $V_{GS(TH)}$ at 200° C. is therefore 0.58×2.75V=1.595V. The value of $\Delta V_{GS(TH)}$ (the difference between the values at 25° C. and 200° C.) is therefore 1.155V. Using Equation (4) above, with the values for $R_1$ and $R_2$ given above, the voltage drop across each of the gate threshold amplifiers 10*a* and 10*b* at 200° C. is:

$$\Delta V_{DS}=1.155\times(R_1+R_2)/R_2=1.155\times(100+1.39)/1.39=84.25V. \quad (7)$$

The total change (decrease) in the voltage drop across the two gate threshold amplifiers 10*a* and 10*b* is thus twice the value of $\Delta V_{DS}$, or 168.5V. Thus, if the total voltage drop across the thermal compensation device 26 at 25° C. is 400V, the total voltage drop at 200° C. would be 231.5V.

Figure 1:
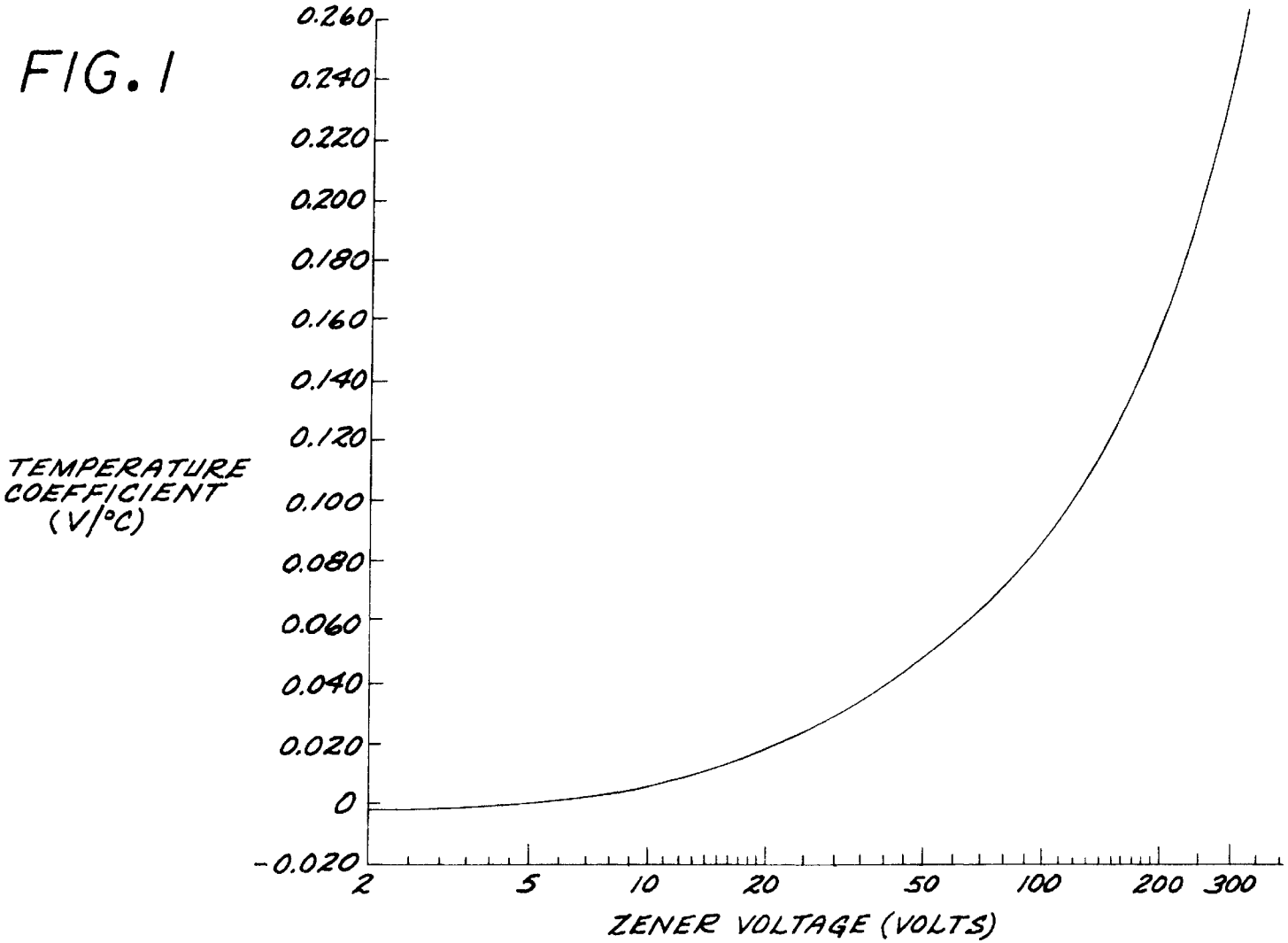
FIG. 1 is a representative graph of temperature coefficient versus reverse breakdown voltage for a typical zener diode.

From FIG. 1, it is seen that the temperature coefficient for each of the zener diodes 24 at 200° C. is about 0.16V/° C. Thus, the string of six zener diodes 24 will exhibit an increase in total zener voltage of:

$$6\times0.16V/^\circ C.\times\Delta T=0.96V/^\circ C.\times(200-25)^\circ C.=0.96V/^\circ C.\times175^\circ C.=168V, \quad (8)$$

where ΔT is the temperature differential between 25° C. and the expected ambient temperature at which the device is expected to operate, and for which the temperature coefficient is taken (in this case, 200° C.).

Therefore, the total zener voltage of the zener string will increase by 168V (from 1200V to 1368), which is substantially compensated by the 168.5V decrease in the voltage drop (from 400V to 231.5V) across the two gate threshold amplifiers 10. Accordingly, the total voltage regulated by the regulator circuit 20 remains substantially the same at 200° C. as it is at 25° C.

In practice, the zener diodes 24 will have zener voltages that may vary from a nominal value by as much as about plus or minus 5 percent. Likewise, the MOSFETs 12*a*, 12*b* will have gate threshold voltages that may vary from the nominal value by a similar amount. These variations may be accommodated by using, for $R_1$, a fixed precision resistor (e.g., 1% tolerance) of the same resistance in each gate threshold amplifier, and then selecting a value for $R_2$ that yields the desired results. The technique for doing this would be well-known to those of ordinary skill in the pertinent arts.

Although a specific example of a preferred embodiment of the invention has been described in detail above, the principles of the present invention will be readily employed in voltage regulator circuits having a wide range in the values of their operational parameters (e.g., total regulated voltage, shunt regulation current, ambient operating temperature). Thus, voltage regulator circuits in accordance with the present invention will be easily designed, with reference to the instant disclosure, by those skilled in the pertinent arts to accommodate a wide variety of needs and applications.

While a specific preferred embodiment has been described herein, it will be appreciated that a number of variations and modifications may suggest themselves to those skilled in the pertinent arts. For example, while the preferred embodiment described herein uses N-channel MOSFETs, P-channel MOSFETs may also be used, with circuit modifications that would be readily apparent to those skilled in the pertinent arts. These and other variations and modifications should be considered within the spirit and scope of the present invention, as defined in the claims that follow.

What is claimed is:

1. A voltage regulator circuit for operation in a temperature range of about 150° C. to at least about 200° C. with a shunt regulation current of no more than about 500 $\mu$amps, comprising:

a high voltage device having a predetermined reverse conduction threshold voltage; and a thermal compensation device connected in series with the high voltage device, the thermal compensation device comprising a gate threshold amplifier including a voltage-controlled resistive device having a negative temperature coefficient, wherein, throughout the temperature range of about 150° C. to about 200° C., the voltage-controlled resistive device has a gate threshold voltage that is less than its gate threshold voltage at 25° C.

2. The voltage regulator circuit of claim 1, wherein the voltage-controlled resistive device is a MOSFET.

3. The voltage regulator circuit of claim 1, wherein the gate threshold amplifier comprises:

a voltage divider comprising first and second resistors connected in series between a first terminal and a second terminal of the gate threshold amplifier, the voltage divider including an intermediate tap between the first and second resistors; and a MOSFET having a drain and a source respectively connected to the first and second terminals of the gate threshold amplifier, and a gate connected to the intermediate tap of the voltage divider.

4. The voltage regulator circuit of claim 1, wherein the high voltage device includes a zener diode.

5. The voltage regulator circuit of claim 2, wherein the high voltage device includes a zener diode.

6. The voltage regulator circuit of claim 3, wherein the high voltage device includes a zener diode.

7. The voltage regulator circuit of claim 4, wherein the high voltage device includes a plurality of zener diodes connected in series.

8. The voltage regulator circuit of claim 5, wherein the high voltage device includes a plurality of zener diodes connected in series.

9. The voltage regulator circuit of claim 6, wherein the high voltage device includes a plurality of zener diodes connected in series.

10. The voltage regulator circuit of claim 1, wherein the thermal compensation device comprises a plurality of gate threshold amplifiers connected in series.

11. The voltage regulator circuit of claim 2, wherein the thermal compensation device comprises a plurality of gate threshold amplifiers connected in series.

12. The voltage regulator circuit of claim 3, wherein the thermal compensation device comprises a plurality of gate threshold amplifiers connected in series.

13. The voltage regulator circuit of claim 4, wherein the thermal compensation device comprises a plurality of gate threshold amplifiers connected in series.

14. The voltage regulator circuit of claim 5, wherein the thermal compensation device comprises a plurality of gate threshold amplifiers connected in series.

15. The voltage regulator circuit of claim 6, wherein the thermal compensation device comprises a plurality of gate threshold amplifiers connected in series.

16. The voltage regulator circuit of claim 7, wherein the thermal compensation device comprises a plurality of gate threshold amplifiers connected in series.

17. The voltage regulator circuit of claim 8, wherein the thermal compensation device comprises a plurality of gate threshold amplifiers connected in series.

18. The voltage regulator circuit of claim 9, wherein the thermal compensation device comprises a plurality of gate threshold amplifiers connected in series.

19. A voltage regulator circuit for operation in a temperature range of about 150° C. to at least about 200° C. with a shunt regulation current of no more than about 500 $\mu$amps, comprising:

a string of zener diodes connected in series; and a thermal compensation device connected in series with the string of zener diodes, the thermal compensation device comprising a plurality of MOSFET gate threshold amplifiers connected in series, wherein, throughout the temperature range of about 150° C. to about 200° C., each of the MOSFET gate threshold amplifiers has a gate threshold voltage that is less than its gate threshold voltage at 25° C.

20. The voltage regulator circuit of claim 19, wherein each of the MOSFET gate threshold amplifiers comprises:

a voltage divider comprising first and second resistors connected in series between a first terminal and a second terminal of the gate threshold amplifier, the voltage divider including an intermediate tap between the first and second resistors; and a MOSFET having a drain and a source respectively connected to the first and second terminals of the gate threshold amplifier, and a gate connected to the intermediate tap of the voltage divider.

21. The voltage regulator circuit of claim 19, wherein the circuit operates with a shunt regulation current of between about 25 $\mu$amps and about 500 $\mu$amps.

22. A voltage regulator circuit for operation in a temperature range of about 150° C. to at least about 200° C. with a shunt regulation current of no more than about 500 $\mu$amps, comprising:

a string of zener diodes connected in series; and a series string of MOSFET gate threshold amplifiers connected in series with the string of zener diodes, wherein, throughout the temperature range of about 150° C. to about 200° C., each of MOSFET gate threshold amplifiers has a gate threshold voltage that is less than its gate threshold voltage at 25° C., and wherein each of the MOSFET gate threshold amplifiers comprises:

a first terminal and a second terminal;

a voltage divider comprising first and second resistors connected in series between the first and second terminals, the voltage divider including an intermediate tap between the first and second resistors; and a MOSFET having a drain and a source respectively connected to the first and second terminals, and a gate connected to the intermediate tap of the voltage divider;

wherein the first terminal of a first one of the string of gate threshold amplifiers is connected to the string of zener diodes, and the first terminal of each of the other gate threshold amplifiers is connected to the second terminal of a preceding gate threshold amplifier in the string of gate threshold amplifiers.

23. The voltage regulator circuit of claim 21, wherein the circuit operates with a shunt regulation current of between about 25 $\mu$amps and about 500 $\mu$amps.

* * * * *